United States Patent [19]

Schmanski

[11] Patent Number: 4,611,949

[45] Date of Patent: Sep. 16, 1986

[54] DETACHABLE BASE FOR ROAD DELINEATORS

[75] Inventor: Donald W. Schmanski, Carson City, Nev.

[73] Assignee: Carsonite International Corporation, a Division of AMETEK, Carson City, Nev.

[21] Appl. No.: 676,803

[22] Filed: Nov. 29, 1984

Related U.S. Application Data

[63] Continuation-in-part of Ser. No. 572,366, Jan. 20, 1984, Pat. No. 4,571,118, and a continuation-in-part of Ser. No. 311,350, Oct. 14, 1981, Pat. No. 4,511,281.

[51] Int. Cl.[4] ..... E01F 9/00

[52] U.S. Cl. ..... 404/9; 404/10; 220/306

[58] Field of Search ..... 404/6, 8, 9, 10, 11, 404/12, 13; 248/158, 160, DIG. 10; 40/606, 607, 609, 612; 116/63 R; 220/354, 355, 306

[56] References Cited

U.S. PATENT DOCUMENTS

| | | | |
|---|---|---|---|
| 1,337,947 | 4/1920 | O'Toole | 404/10 X |
| 1,653,897 | 12/1927 | Farr | 248/158 X |
| 2,726,517 | 12/1955 | Pruett | 220/355 X |
| 3,119,588 | 1/1964 | Keats | 40/606 X |
| 3,212,415 | 10/1965 | Byrd | 404/10 |

*Primary Examiner*—James A. Leppink
*Assistant Examiner*—Matthew Smith
*Attorney, Agent, or Firm*—Thorpe, North & Western

[57] ABSTRACT

A deformable, detachable base for supporting and stabilizing an attached vertical sign or delineator in upright orientation with respect to a ground or road surface to which the base may be affixed. The detachable base includes a deformable, domed structure comprised of a top, intermediate body wall and base attachment channel. The base attachment channel includes first and second channel walls, and a third radial flange which projects inward from the second channel wall toward a central axis of the domed structure. Accordingly, three (3) enclosing walls define a channel enclosure which is utilized to retain the domed structure in attachment to a rigid base plate. The base plate has a vertically oriented lip at its perifery which is adapted in size and configuration for a tight, contour fit within the channel enclosure. The inventive structure enables easy attachment and removal of the domed structure to the base plate during non-impacting conditions; however, the same domed structure responds to vehicle impact by gripping more tightly at the base plate lip to thereby hold its attached condition despite high speed vehicular impact.

17 Claims, 7 Drawing Figures

DETACHABLE BASE FOR ROAD DELINEATORS

This is a continuation in part of U.S. application No. 311,350 filed Oct. 14, 1981 now U.S. Pat. No. 4,511,281 and U.S. Pat. No. 572,366 filed Jan. 20, 1984 now U.S. Pat. No. 4,571,118.

BACKGROUND OF THE INVENTION

1. Field of the Invention

This invention pertains to delineation and sign support devices having a deformable base which permits the device to be run over by a vehicle without damaging the vehicle, the sign, or the base. More particularly, it pertains to a removable support device which can be easily attached to different locationns at a road or ground surface.

2. Prior Art

Delineation and sign devices are placed at various locations for controlling and directing the flow of traffic. Such locations include concrete, asphalt and other paved surfaces, as well as road bridge surfacing, gravel, road base and dirt. Because of the extreme divergence of physical characteristics for each of these materials, it has been very difficult to find a single support base which is suited for implacement generally. For example some delineation devices are glued at their base to the pavement, whereas other devices are buried in the soil.

A common deficiency with most support bases adapted for holding a delineator or sign post in upright orientation is the inability of the base to be detached or implaced at will. This deficiency is particularly troublesome when the delineator or sign is repeatedly shifted between two or more locations. For example, morning traffic may require delineator devices directing traffic into numerous rush hour lanes; whereas evening traffic may require switching the delineation devices to increase the rush hour lanes in the opposing directions. Obviously, it is not feasible to adhesively apply such delineators on such a recurring basis because expense and time factors are prohibitive. A form of detachable base is required which enables a maintenance crew to quickly move the delineators from a first location to a second location without excessive effort.

Prior art approaches for detachable delineation devices have included the use of holes bored or preformed in the road surface which are readily adapted for receiving and releasing the delineator. Unfortunately, installation of such holes is expensive and typically permanent. Changes in traffic patterns, seasons of the year and other needs generally dictate against such permanent means of attachment of the delineator.

U.S. Pat. No. 1,337,947 illustrates a deformable delineator or sign support which has a domed shaped support base suitable for attachment to a paved surface. This reference discloses the prior art of attaching a support base or delineator to pavement wherein the base is bolted in place. Although the use of bolts enables the device to be removed at will, the process is time consuming and typically requires a threaded lug or other type of embedded nut for receiving the bolt and anchoring it to the pavement surface. Although the bolting of various types of delineator bases has continued in use, the limitations of (i) excessive time for implacement and removal, and (ii) high installation and maintenance expense constitute a long-felt need begging solution.

U.S. Pat. No. 2,719,214 illustrates an additional delineation device having a deformable base which is mounted to a receptacle pre-formed within a paved structure. The figures clearly illustrate the aforementioned problems of excessive installation time and expense.

A second problem which has troubled traffic engineers for years is the tendency of a flexible delineator to deform around the bumper of the impacting vehicle at higher speeds. With the increased speed of today's traffic, such problems associated with flexible delineator structures at impact have significantly increased. A significant deficiency associated with this problem is the "gripping - effect" which occurs as the flexible delineator structure deforms over the front of the vehicle and bumper. This initial deformation increases the frictional contact between the vehicle and delineator and tends to grab hold of the delineator and pull it free from its mounting structure. If the delineator is mounted on a paved surface by adhesive, the strength of the adhesive is typically exceeded and breaks free from the road surface. If, on the other hand, the delineator is mounted in the ground or in a back-filled condition, the delineator may simply be extracted from its buried position.

The tendency of flexible delineators to be torn free from their mounted locations creates a severe problem where the delineator is intended to be detachable. Intuitively, the easier the device is to separate from its base, the more likely such separation will occur under impact conditions which apply the same type of lifting stress. Consequently, the intended ease of detachability for the delineator has characteristically been inversely proportional with the rate of speed anticipated at impact between the vehicle and the delineator. In high velocity areas, the anchoring of the delineator is generally more permanent. Where slower speeds exist, such as in maintenance or construction zones, the sturdiness of attachment can be sacrificed in favor of portability. It will be apparent to those skilled in the art that similar opposing design comparisons can be made with respect to other properties unique to the field of delineation devices and their attachment to various types of surfaces. The foregoing examples are merely illustrative of numerous conditions which have remained unsolved for many years. As a consequence, highway engineers presently design delineators to meet the more important consideration of survivability in an operable condition, and sacrifice other conditions such as convenience in implacement or detachment.

OBJECTS AND SUMMARY OF THE INVENTION

It is therefore an object of the present invention to provide a deformable support base for a delineator or sign support which snaps in place and can be subsequently removed with minimal effort and time.

It is a further object of the present invention to provide a deformable support base having the foregoing properties, but which likewise has the ability to survive high speed impacts without being pulled free from its mounted condition by the impacting vehicle.

It is a still further object of the present invention to provide a deformable support base which is adapted for attachment to a road surface, gravel or ground condition with equal versatility.

A still further object of the present invention is to provide a deformable support base which has sufficient strength to retain a delineator or sign in upright orientation, despite repeated impact by high-speed vehicles.

These and other objects are realized in a deformable, detachable base for supporting and stabilizing an attached vertical member, such as a sign or delineator, in upright orientation with respect to a road surface or other flat surface to which the base may be attached. The base comprises a single, integral domed structure which includes a base attachment channel formed of a resilient, elastic composition and adapted for snap-on attachment to a peripheral flange of a base plate which is adhered or otherwise attached to the road surface or ground where the vertical member is to be positioned.

Other objects and features of the present invention will be apparent to those skilled in the art based upon the following detailed description, taken in combination with the drawings which include:

FIG. 1, showing a perspective view of a support base constructed in accordance with the teachings of the present invention;

FIG. 2, which shows a segment of FIG. 1 in cross-sectional view, taken along 2—2;

FIG. 3, which illustrates a partially exploded, cross-sectional view along the plane which cuts through the support base along lines 2—2 of FIG. 1;

FIG. 4, depicting a bottom view of the support base shown in FIG. 1 taken along the lines 4—4; without the base plate attached;

FIG. 5, illustrating a hemispherical embodiment of the subject invention; and FIG. 6, which discloses a detachable base and attached delineator structure;

FIG. 7, showing a partially cut-away view of the base plate illustrating the effect of forces arising during impact stress.

DETAILED DESCRIPTION OF THE INVENTION

Referring Now to the Drawings

Figure 1:
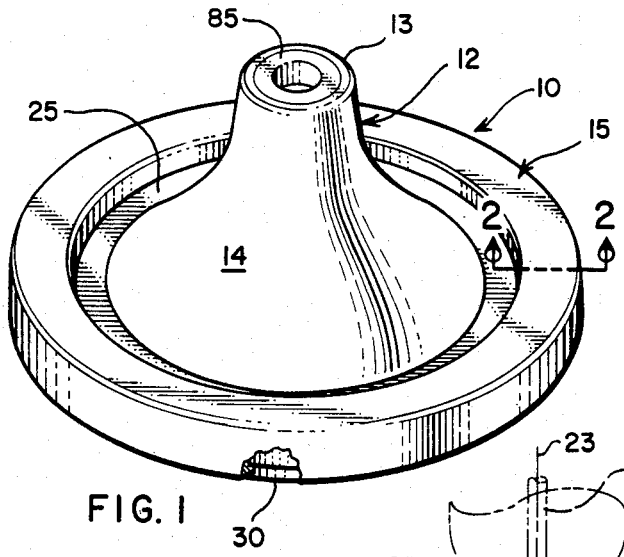
Figure 2:
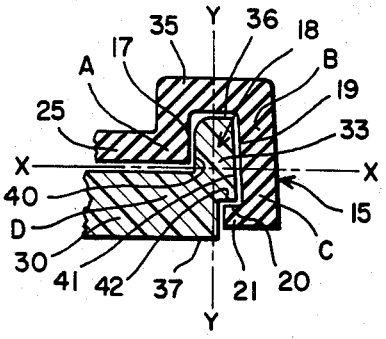

FIGS. 1–2 show a deformable, detachable base 10 for supporting and stabilizing attached vertical member 11 in upright orientation with respect to a ground or road surface to which the base may be fixed. The basic structure includes a deformable, domed structure 12 which includes an inter-connected top 13, intermediate body wall 14 and base attachment channel 15. The channel 15 is shown more clearly in FIG. 2. This channel is constructed of a resilient, elastic composition and is attached at the periphery of the body 14.

The base attachment channel 15 is constructed with an inward channel wall 17 which forms the interior side of the channel enclosure 18. An outward channel wall 19 forms the other side of the channel enclosure 18 and is coupled at its top to the inward channel wall. A third channel wall 20 is formed by a flange 21 which is attached at a lower part of the outward channel wall 19 and projects inward toward a central axis 23. The base attachment channel 15 is inter-connected with the perimeter of the intermediate body wall 14 by means of an annular ring 25 which has a radial orientation with respect to the central axis 23 and is adapted to lay flat with respect to the surface of an attached base plate 30.

Figure 4:
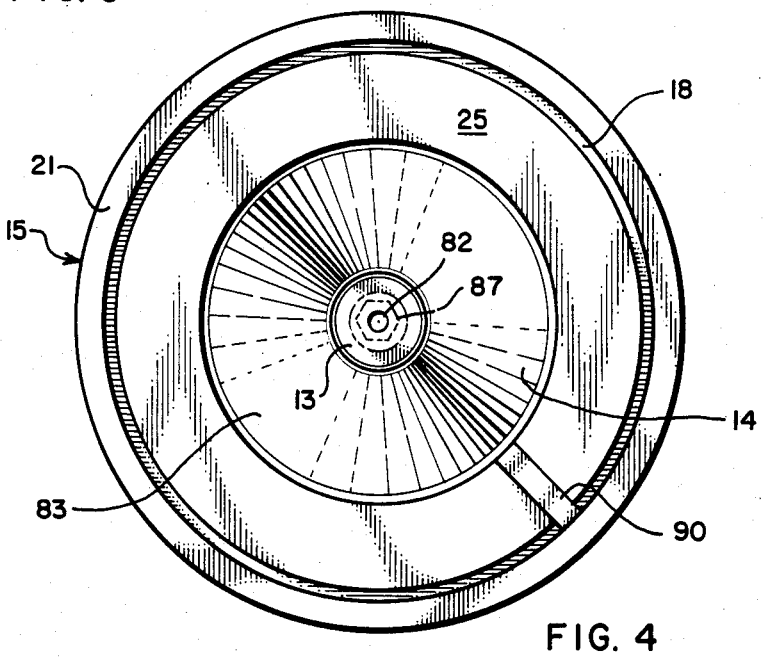

Accordingly, the base attachment channel provides a tortuous path through which impact forces must be carried prior to any possibility of separation of the detachable base from the base plate. These forces are carried into the annular ring 25 in response to an impact force F (FIG. 4). The force path around the base attachment channel is along the annular ring 25, bending at 90 degrees along the inward channel wall and bending again at 90 degrees along the top of the channel. A third 90 degree turn is imposed on the force as it travels into the outward channel wall, and bends an additional 90 degrees upon reaching the third wall for the channel enclosure or lower flange 21. By imposing this tortuous path upon the impact force, a separation of the base from the base plate is substantially impeded. The subject invention has demonstrated its ability to withstand impact forces of 55 miles an hour without being pulled free from the base plate 30 which is adhered to a highway surface.

The base plate 30 is designed for attachment to the ground or road surface in a permanent manner. For example, the bottom surface 31 can be adhesively attached to the cement or asphalt surface of a road. Alternatively, spikes can be driven through openings 32 to adapt the base plate for mounting in the ground. Numerous other methods for attachment of the base plate to its permanent ground location will be perceived by those skilled in the art. The primary criteria for attachment is that the base plate can be retained at its ground or road surface point of attachment despite an impact of 50 to 60 miles an hour via the moving vehicle.

Typically, the base plate will be a rigid, flat structure formed of a high strength polymer which can be injection molded or otherwise formed to provide a tight fit when mounted within the base attachment channel. As shown in FIG. 2, the rigid base plate is adapted near its periphery with a vertically oriented lip 33 adapted in size and configuration for removable attachment in a tight, contour fit within the three channel walls 17, 19 and 20 of the channel enclosure 18. Generally, the attachment lip 33 will have an exterior configuration substantially conforming to the interior configuration of the channel enclosure 18. This provides maximum friction contact between the wall surfaces of the channel 17, 19 and 20.

Although many configurations for the lip and enclosure channel are feasible, the embodiment illustrated in FIG. 2 has proved most effective. Its structure can be defined within the four quadrants of a circle 35 whose diameter extends from the top of the lip 36 to the bottom of the base 37. Three separate lip surfaces are identified. Surface 40 is adapted for frictional contact with the inward channel wall 17. This first lip surface 40 has most of its surface area or primary surface in a first upper quadrant A nearest the central axis. A second lip surface 41 is in opposing position to the outward body wall 19 and has its primary surface in the remaining upper quadrant B. A third lip surface 42 opposes the flange wall 20 and has its primary surface in the lower two quadrants C and D. The first and second lip surfaces, 40 and 41, are primarily oriented along the vertical axis Y of the quadrant and the third surface 42 is primarily oriented along the horizontal axis X. By adapting the lip cross section and cross section of the channel enclosure 18 to substantially the same shape, a contour fit of the base plate is achieved within the base attachment channel (also referred to herein as the "base plate attachment member"). In the configuration illustrated in FIG. 2, it should be noted that the peripheral lip 33 is positioned in a vertical orientation in a corresponding position to the channel enclosure or channel opening 18 of the base plate attachment member whose opening is oriented downward.

The disclosed structure provides two contrasting performance characteristics. In the absence of impacting forces, the deformable, domed structure 12 is adapted for removable attachment at the base plate 30. This attachment is accomplished by pulling radially outward on the flange 21 and attached outward body wall 19. This releases the flange from its contact at the third lip surface 42 to broaden the opening of the channel enclosure 18. In this condition, the lip can be inserted or withdrawn with minimal effort. Because the flange 21 is adapted for a snug, elastic fit around the base plate 30 the insertion or release of the base plate is accomplished gradually by moving from a starting point at the perifery wherein the flange 21 is in a seated position, and then continuing to release or insert the lip along both directions of the perifery until the two sides meet at the opposing side. The action is similar to snapping or releasing a tight lid to the top of a jar or container. The removable quality of this structure exists where direct forces are applied to the base attachment channel. For example, a direct force would be applied by maintenance personnel who directly grasp the outer wall structure 19 and pull it free from the lip 33.

Figure 6:
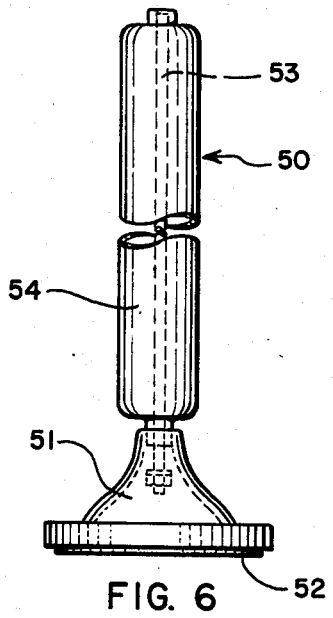
Figure 7:
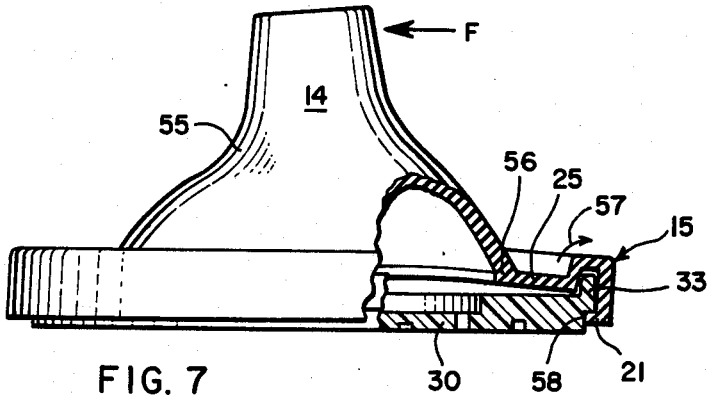

This is in contrast to indirect forces which are applied to the base attachment channel. Where such indirect forces are transmitted through the domed structure 12 into the base attachment channel 15, the base resists detachment from the base plate. This is partially due to the distribution of impact forces over the walls of the channel in the tortuous path previously described. The distribution over these forces, in combination with frictional contact between the base plate lip 33 and the surrounding channel wall structure 17, 19 and 20 prevents release of the lip from the channel enclosure 18. The inventor has discovered that this gripping response is surprisingly effective in retaining attachment between the domed structure and base plate. The unusual and surprising results of the present invention are best appreciated by comparing (i) the simplicity of attachment where direct forces are applied to the base attachment channel and (ii) the resistence to detachment, despite the tremendous loading which occurs, where a high speed vehicle impacts an attached delineator 50 such as shown in FIG. 6. Whereas prior art devices suggest that the detachable base 51 would be pulled free from the base plate 52 at such extreme impact conditions, just the opposite occurs. The greater impact force, carried indirectly through the domed structure into the base attachment channel, results in an increased gripping action around the periphery of the base plate, which operates to hold the detachable base 51 in its proper, attached condition.

In fact, the preferred embodiment disclosed in FIG. 1–4 developes yet another structural response to a force F applied to the domed structure 14. The impact by force F causes a partial collapse 55 in the intermediate body wall. Concurrently, the periphery of the body wall 56 and anular ring 25 are pulled upward and away from the base plate 30. The rotational motion 57 sets the base attachment channel 15 in partial rotation around the base lip 33. This causes the lower flange 21 to seat in the groove 58 formed within the base plate. In otherwords, the inward projecting channel flange 21 responds to the impact forces F applied across the central axis and transmitted through the domed structure by being drawn into tension against the base plate. Instead of tending to release itself from the base plate, the base attachment channel 15 developes a gripping force which tends to maintain the desired attachment when impact forces are present. This gripping force is greater because of the presence of impact forces which are indirectly transmitted into the base attachment channel.

Figure 5:
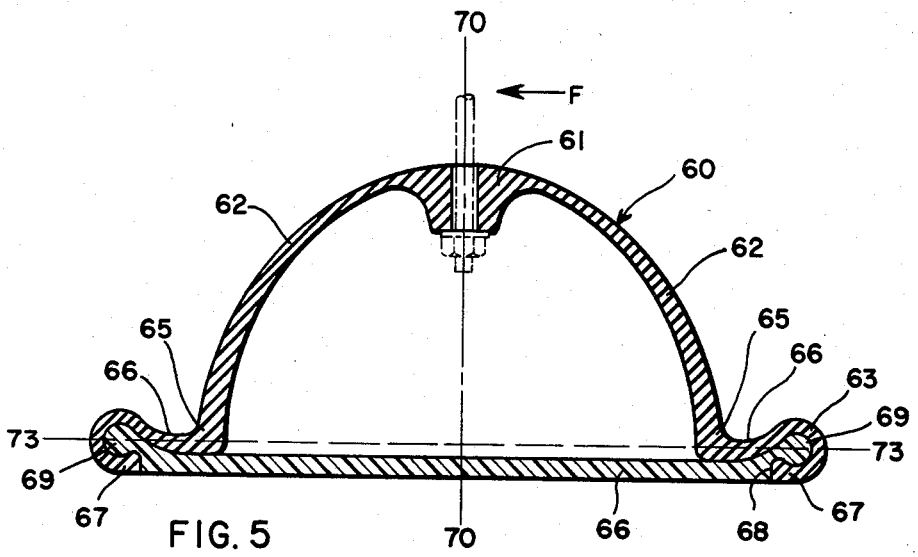

It will be apparent to one skilled in the art that the composition and geometric configuration of the domed structure 12 may vary substantially. For example, FIG. 5 illustrates a hemispherical domed structure 60 having a reinforced top 61, thin, intermediate body wall 62 and arcuate base attachment channel 63. The periphery 65 of the intermediate body wall is thicker to increase the mass and stiffness of the structure at the point of attachment to the base attachment channel 63. There is also a flattened section 66 corresponding to the annular ring 25 which operates to increase the distance through which the impact forces must travel in order to reach the base attachment channel 63. It should also be noted that initial tension applied to the intermediate body wall 62 upon impact by force F results in lifting forces being primarily applied at the periphery 65 or elbow of the dome, rather than at the attachment channel 63. As with the conically shaped structure of FIG. 4, the impact force F tends to pull the elbow represented at item 65 into a more straightened configuration between the top of the dome 61 and the attachment channel 63. As this elbow 65 raises from the base plate 66, it tends to drive the remote end 67 of the attachment channel 63 into the gripping position at the recess 68 below the retaining lip 69. Here again, the internal surface configuration of the channel 63 and the external surface configuration of the contacting base plate 66 and retaining lip 69 should conform to maximize frictional contact and gripping action. This gripping action is enhanced where at least a portion of the channel flange 21 and 67 and the corresponding recessed perimeter 42 and 68 are radially oriented with respect to the central axis 23 and 70 of the base structure.

Similarly, the base attachment channel configuration and the peripheral lip structure of the base plate can be configured in numerous geometrical shapes. Two examples have been provided in this disclosure to illustrate the operable principles. In the embodiment represented by FIGS. 1–4, the lip comprises first and second lip surfaces 40 and 41 which are substantially concentric with the vertical axis 23. The third lip surface 42 forms part of the recessed channel and is at least approximately 270 degrees from the second lip surface. This third lip surface resists the tension applied to the radial flange 21 during impact and operates to retain the attached configuration between the base plate and domed structure.

It will be apparent to one skilled in the art that additional lip surfaces beyond the three provided 40, 41 and 42 may be incorporated to further extend the indirect path required for impact forces to reach the radial flange. As has been indicated, the purpose of these lip surfaces with opposing directions is to develop a complex distribution of stress around the base attachment channel. A minimum of three (3) changes in direction are required to insure the tension of the domed structure during impact with vehicles traveling at high speeds.

The lip structure of FIG. 5 illustrates the limiting example of increasing the number of lip surfaces and required changes in direction for the indirectly transmitted impact forces. In this embodiment, the lip cross-section is an arcuate or circular cross-section wherein the arch extends through at least approximately 180 degrees. This arch is represented by the interior surface of the base attachment channel 63 and its opposing contacting lip surface of the retaining lip 69. In both embodiments, the channel enclosure and external lip surface configuration should be adapted to insure a tight fit therebetween.

The point of attachment between the base attachment channel (base plate attachment member) in the preferred embodiment is defined by relationship to a plane (72 in FIG. 2 and 73 in FIG. 5) which is normal to the central axis 23 and 70 respectively and also intercepts the channel enclosure within the base attachment channel 15 and 63. The point of attachment between the periphery of the body wall and the base attachment channel is positioned substantilly along this plane 72 and 73. In the disclosed embodiments, the respective annular rings 25 and 66 provide the attachment structure within these guidelines. As previously indicated, this structure develops an elbow 24 and 65 which enhances rotational movement of the base attachment channel 15 or 63 about the retaining lip 33 or 73. As indicated in FIG. 4, item 57, this movement is oriented toward the channel flange 21 in response to radial forces F which are applied to the domed structure and toward the central axis. As is indicated in the drawings, the attachment between the periphery of the lower body wall, annular ring and base attachment channel are part of a single, continuous integral structure which extends into the body wall and top of the domed structure.

The use of viscoelastic or rubberlike materials further enhances the gripping performance of the base attachment channel. Such materials are somewhat incompressible, meaning that tension arising from pulling forces applied through the body wall require other parts of the material to tighten and thereby grip around the base plate. The use of such viscoelastic or rubber compositions further enhances the contrasting characteristics of being easily implaced or moved by directly lifting the radial flange 21 or 67, despite the fact that this same radial flange tightens its grip around the base plate when stressed by indirect forces through the domed structure. Although rubber has been used as the preferred composition, it would be apparent to those skilled in the art that other viscoelastic and rubberlike materials would offer similar performance characteristics.

Such materials also offer a deformable characteristic to the base structure which is ideal for impact environments with motor vehicles. Specifically, the conical or hemispherical body wall or mid section is structured to provide sufficient flexibility to deform when subject to compression or elongation stress such as shown in item 55, FIG. 4. This type of collapse of the body wall represents the type of mechanical failure which is well suited for distribution of forces into the base attachment channel without separation from the base plate. In addition to providing flexibility under impact conditions, the domed structure develops sufficient stiffness to provide resilience for supporting an attached vertical member in upright orientation. As will be noted in the drawings, the top 13 or 61 is integrally formed and attached at an upper portion of the walled body 14 or 62 and is adapted with greater stiffness (based on wall thickness) to favor deformation of the walled body under impact stress in preference to deformation of the top. By imposing collapse of the base structure over the broad surface of the intermediate body wall, the chance of elastic failure due to localized stress is greatly reduced. Therefore, the subject structure can take repeated impacts and maintain its resilience to restore the attached delineator to proper upright orientation. These features are more fully set forth in parent applications identified previously.

Because the subject support base can be easily attached or removed, yet can at the same time withstand high speed vehicle impacts without separating from the attached base plate, it represents a versatile support base suitable for mounting signs, delineators and other upright objects which are subject to impact at a road or ground surface. FIG. 6 is exemplary of such applications and shows the subject support base 51 attached to the base plate 52. A delineator device 50 is designed in accordance with the disclosure of U.S. patent application No. 06/572,366 and includes a stiffening member 53, such as a fiberglass rod, which is rigidly affixed to the support base 51 such that deflection of the stiff member by an impacting vehicle or load results in transfer of most of the load into the base support. Deformation of the base support is in accordance with FIG. 4 wherein the domed structure deflects and partially collapses, thereby avoiding a tendency of the delineator to wrap around the bumper or other impacting load. The stiffening member 53 is enclosed and protected within a more flexible, plastic tube 54 which provides the federally required width dimension for the delineator device. Without the stiffening member 53, the plastic tube would easily wrap around the bumper of an impacting vehicle and would be pulled free from the support base.

Numerous methods of attachment of the delineator or sign to the support base can be envisioned. FIG. 2 and the related figures illustrate the preferred attachment structure, with the attached delineator 11 shown in phantom line. Delineator 11 includes a fiberglass stiffening member 80 which extends the length of the delineator body and projects below the closed end of the delineator tube 81 through an opening 82 which extends into the enclosed area 83 within the conical dome 14. A larger recessed opening 84 is provided at the top of the support base for insertion of the closed end 81 of the tube. A metal washer or ring 85 provides reinforcing strength to the top of the support base. The stiffening member 80 includes a threaded lower end for attachment of a locking nut 87 which is mounted at the end of the rod 80 and is used to lock the delineator 11 in an attached position at the top 13 of the base support.

Figure 3:
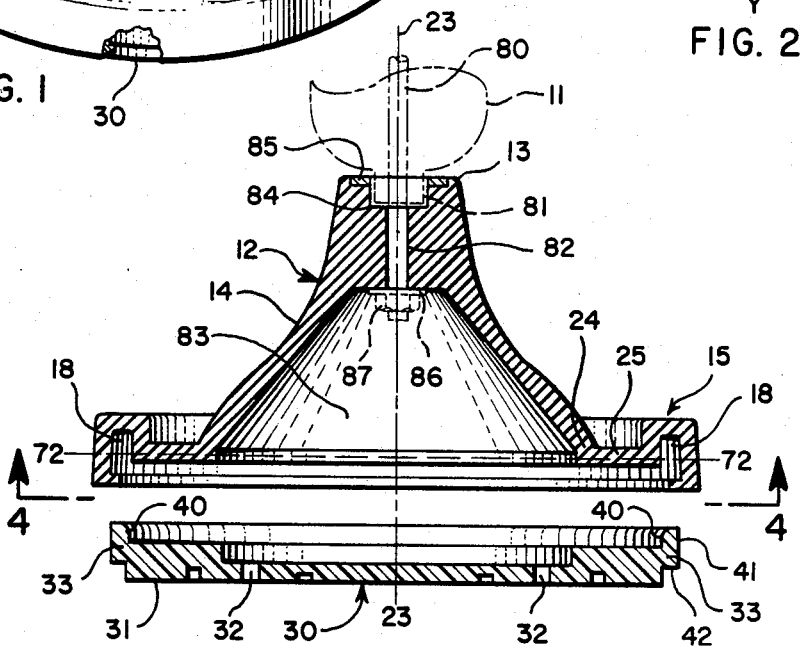

In some circumstances, it may be desirable to lock the domed structure 12 in a fixed position with respect to the base plate 30. This would be desirable when it is necessary to prevent rotational movement of the domed structure and attached sign or delineator with respect to the fixed base plate on the ground. FIG. 3 illustrates the use of a locking tab 90 which projects downward from the anular ring 25 and extends across the channel enclosure, attaching at the interior walls of the base attachment channel 15. A corresponding groove is formed in a top surface of the base plate and through the retaining lip 33. The domed structure is positioned so that the locking tab 90 inserts in the slot of the base plate such that rotational movement between the two attached structures is precluded. It would be apparent that other means for locking the relative position of the two members can be applied with equal simplicity. It is also to be understood that the specific embodiments disclosed herein are not to be construed as limiting, except to the extent required by the following claims.

I claim:

1. A deformable, detachable base for supporting and stabilizing an attached vertical sign or delineator member in upright orientation with respect to a ground or road surface to which the base may be affixed, said base comprising:

a. a deformable, resilient, domed structure having an integrally formed (i) top, (ii) intermediate body wall and (iii) base attachment channel, said channel being formed of a resilient, elastic composition at the periphery of the body wall and including an inward channel wall forming one side of a channel enclosure and an outward channel wall coupled at its top to the inward channel wall forming another side of the channel enclosure and further including a flange attached at a lower part of the outward channel wall and projecting inward toward a central axis thereof to thereby form a third wall for the channel enclosure, said domed structure being configured about the central axis in the general shape of a dome;

b. a rigid, flat base plate adapted near its periphery with a substantially vertically oriented lip adapted in size and configuration for removable attachment in a tight, contour fir within the three channel walls of the channel enclosure and being further adapted with means for attachment to the ground or other flat mounting surface;

c. said domed structure including means at the top thereof for mounting a delineator or sign member, said mounting means providing a primary transfer path for stress occurring as a result of impact between a fast moving vehicle and the attached delineator or sign member wherein impact forces are transferred directly into the top of the dome and indirectly through the intermediate body wall into the base attachment channel, said indirect forces being operable to tighten the attachment of the base attachment channel at the base plate;

d. said base attachment channel further providing for immediate detachment at the base plate by direct forces applied by lifting the outer wall of the channel to insert the lip of the base plate therein, yet being adapted at the same time to resist detachment from the base plate in response to the indirect forces applied to the channel through the domed structure wherein forces are distributed over the walls of the channel and where increased frictional contact with the base plate prevents release of the lip from the channel enclosure.

2. A device as defined in claim 1 wherein the channel flange which projects inward from the outer channel wall responds to impact forces applied across the central axis and through the domed structure by being drawn into tension against the base plate to thereby respond at the periphery the base plate with a gripping force which is greater than when impact forces are absent.

3. A device as defined in claim 1 wherein said base attachment channel is integrally formed with and is continuous around the periphery of the lowest portion of the body wall of the domed structure.

4. A device as defined in claim 1 wherein the point of connection between the base attachment channel and the periphery of the body wall is positioned substantially along a plane normal to the central axis and intercepting the channel enclosure to thereby develop rotational movement of the channel walls about the base lip and toward the channel flange in response to radial forces applied to the domed structure toward the central axis, thereby forcing the flange into a more secure position at the base plate.

5. A device as defined in claim 1, wherein the elastic composition of the domed structure comprises a visco-elastic material.

6. A device as defined in claim 1, wherein the elastic composition of the domed structure comprises a rubber-like material.

7. A device as defined in claim 1, wherein the base plate lip has a geometric cross-section conforming to the cross-section of the channel enclosure, including a recessed channel at the perimeter for receiving the channel flange.

8. A device as defined in claim 1, wherein the channel flange and recessed perimeter channel of the base plate are radially oriented with respect to the central axis to enhance the gripping action of the channel flange under the indirect forces.

9. A device as defined in claim 1, further comprising a locking means for locking the domed structure at a predetermined position with respect to the base plate, thereby preventing rotational movement of the domed structure when the base plate is fixed to the ground.

10. A device as defined in claim 1, further comprising a delineator or sign mounted at the top of the domed structure, said delineator or sign including a stiff member extending along the length thereof which is rigidly affixed to the support base such that deflection of the stiff member by an impacting load results in transfer of most of the load into the base support, causing the domed structure to deflect and partially collapse, thereby avoiding a tendency of the delineator or sign to wrap around the impacting load with the attendant risk of being pulled free from the support base.

11. A deformable detachable base for supporting and stabilizing an attached vertical member in upright orientation with respect to a flat surface to which the base may be affixed, said base comprising:

a. a deformable structure having (i) a top, (ii) a body wall and (iii) a base plate attachment member formed of a resilient, elastic composition;

b. a base plate having a substantially flat bottom and a lip positioned above the bottom and near the periphery of the base plate, said lip having a cross-section defined within the four quarants of a circle whose diameter extends from the top of the lip to the bottom of the base and includes three separate lip surfaces comprising a first lip surface having its primary surface in a first upper quadrant nearest the central axis, a second lip surface having its primary surface in the remaining upper quadrant and a third lip surface with its primary surface in the two lower quadrants, said first and second lip surfaces being primarily oriented along the vertical axis of the quadrant and the third surface being primarily oriented along the horizontal axis, said lip being adapted in size and configuration for removable attachment and contour fit within tbe base plate attachment member;

c. said base plate attachment member having a channel opening oriented downward and having a channel configuration corresponding to the cross-section of the three lip surfaces of the base plate lip;

d. said deformable structure including means at the top thereof for mounting a delineator or sign member, said mounting means providing a primary transfer path for stress occurring as a result of impact between a fast moving vehicle and the delineator or sign member wherein impact forces are transferred directly into the top of the deformable structure and indirectly through the body wall into the base plate attachment member, said indirect forces being operable to tighten the attachment of the base attachment member at the base plate;

e. said base plate being further adapted with means for attachment to the ground or other flat mounting surface.

12. A device as defined in claim 11, wherein said body wall comprises a conical midsection having sufficient flexibility to deform when subject to compression or elongation stress yet having sufficient stiffness to provide resilience for supporting an attached vertical member in upright orientation; said top being integrally formed and attached at an upper portion of the walled body and having greater stiffness than the wall body to favor deformation of the walled body under impact stress in preference to the top, said top including means for attaching the vertical member such that the vertical member can withstand a high speed lateral impact without being pulled free from the attached base.

13. A device as defined in claim 12, wherein the deformable structure includes a substantially flat, annular ring coupled between the peripheral base of the conical structure and the base plate attachment member and adapted to rest at an upper surface of the base plate when attached thereto.

14. A device as defined in claim 11 wherein the configuration of the lip comprises first and second lip surfaces which are substantially concentric with the vertical axis and wherein the third lip surface is at least approximately 270 degrees from the second lip surface, said channel having corresponding configuration to insure a tight fit of the lip therein.

15. A device as defined in claim 11, wherein the base plate lip includes at least three lip surfaces which require an applied impact force at the deformable structure to follow a complex path therethrough having at least three changes in direction before reaching the edge of the base plate attachment member.

16. A device as defined in claim 14 wherein the lip is arcuate in cross-section having an arc extending through at least approximately 180 degrees, said attachment gripping member having a corresponding configuration to insure maintenance of the required tight, contoured fit at the lip.

17. A device as defined in claim 11, wherein said body wall comprises a hemispherical midsection having sufficient flexibility to deform when subject to compression or elongation stress yet having sufficient stiffness to provide resilience for supporting an attached vertical member in upright orientation; said top being integrally formed and attached at an upper portion of the walled body and having greater stiffness than the wall body to favor deformation of the walled body under impact stress in preference to the top, said top including means for attaching the vertical member such that the vertical member can withstand a high speed lateral impact without being pulled free from the attached base.

* * * * *